US010801792B2

(12) United States Patent
Pini

(10) Patent No.: US 10,801,792 B2
(45) Date of Patent: Oct. 13, 2020

(54) MAGAZINE FOR A FIREARM

(71) Applicant: MEC-GAR S.R.L., Brescia (IT)

(72) Inventor: Eugenio Pini, Brescia (IT)

(73) Assignee: MEC-GAR S.R.L., Brescia (IT)

( * ) Notice: Subject to any disclaimer, the term of this patent is extended or adjusted under 35 U.S.C. 154(b) by 0 days.

(21) Appl. No.: 16/536,732

(22) Filed: Aug. 9, 2019

(65) Prior Publication Data

US 2020/0064092 A1 Feb. 27, 2020

(30) Foreign Application Priority Data

Aug. 23, 2018 (IT) ..... 102018000008169

(51) Int. Cl.
*F41A 9/65* (2006.01)
*F41A 9/70* (2006.01)

(52) U.S. Cl.
CPC ..... *F41A 9/70* (2013.01)

(58) Field of Classification Search
CPC ..... F41A 9/70; F41A 9/65; F41A 9/67; F41A 9/66
USPC ..... 42/50, 49.01, 6, 7; 89/197
See application file for complete search history.

(56) References Cited

U.S. PATENT DOCUMENTS 5,357,703 A * 10/1994 Chesnut ..... F41A 17/38 42/50
5,438,783 A * 8/1995 Sniezak ..... F41A 9/65 42/50
9,784,513 B2 * 10/2017 Zimmer ..... F41A 9/62
2013/0019511 A1 * 1/2013 Plataniotis ..... F41A 9/65 42/6
2013/0333261 A1 * 12/2013 Clifton, Jr. ..... F41A 9/65 42/50
2017/0336160 A1 * 11/2017 Walther ..... F41A 9/70
2018/0051948 A1 2/2018 Corso
2018/0094886 A1 4/2018 Corso
2019/0025029 A1 * 1/2019 Browning ..... F41A 9/65

FOREIGN PATENT DOCUMENTS

EP 2805123 B1 12/2017

* cited by examiner

*Primary Examiner* — Reginald S Tillman, Jr.
(74) *Attorney, Agent, or Firm* — Polsinelli PC

(57) ABSTRACT

A magazine for a firearm comprises a magazine tube, a removable floor plate assembly attached to the lower end of the magazine tube, a follower and a spring. The floor plate assembly is removable from the lower end of the magazine tube by sliding from the front portion towards the rear portion. The floor plate assembly comprises an L-shaped plate and a removable bottom, equipped with a body compartment suitable to house the primary portion of the L-shaped plate. The L-shaped plate and the floor plate are snap-engageable to attach the floor plate assembly to the magazine tube.

12 Claims, 11 Drawing Sheets

MAGAZINE FOR A FIREARM

CROSS-REFERENCE TO RELATED APPLICATIONS

This application claims priority to the Italian patent application No. 10 2018 000 008 169, filed on Aug. 23, 2018, which disclosure is here incorporated by reference.

FIELD

The subject-matter of the present invention is a magazine for a firearm, in particular a magazine for handguns.

BACKGROUND

As is known, a magazine comprises a prismatic-shaped magazine tube in which the bullets are housed, superimposed vertically. Inside the magazine tube, there is arranged a follower and a spring, placed in compression between the bottom of the magazine tube and the follower. On the bottom of the magazine tube there is arranged a removable floor plate for normal maintenance and cleaning operations of the magazine.

Generally, the floor plate is inserted in the end of the magazine tube, according to a direction of engagement that goes from the front area towards the rear area. The floor plate is then removed by pulling it out of the magazine tube in one direction from the rear area to the front area.

In normal use, the magazine is inserted into the barrel of the firearm.

As one may see, it is extremely important that, as a result of shocks or other sudden and unpredictable external actions, the floor plate does not accidentally separate from the magazine tube and break.

In order to test the reliability of the connection between the floor plate and the magazine tube, the magazine alone and the firearm equipped with the magazine are subjected to a number of tests, in which the magazine and/or the firearm are dropped onto a detection plane from a predefined height (so-called "drop test").

Tests have shown that the impact between the magazine and the detection plane generally occurs at the rear area of the floor plate, most likely due to the usual distribution of the mass.

There is therefore a high risk that the floor plate will disengage from the magazine tube.

There are solutions that provide systems for latching the floor plate to the magazine tube, so as to prevent the floor plate from slipping from the rear area towards the front area; nevertheless, due to impact, these latching systems may break.

Some solutions of the prior art are described in documents US 2018/051948, US 2018/094886 and EP 2805123. These solutions provide for a floor plate that is removable from the lower end of the magazine tube, according to a direction of disassembly that goes from the rear portion towards the front portion, conversely to that which is provided for in the present invention.

OBJECT OF THE INVENTION

The object of the present invention is to construct a magazine with a floor plate assembly that meets the requirements of the sector and at the same time overcomes the drawbacks mentioned above.

This object is achieved by a magazine for a firearm, comprising:

- a magazine tube having a predominant extension along a main axis between a lower end and an upper end, comprising a lateral wall enclosing therein a compartment, wherein the lateral wall comprises a rear portion, sides and a front portion;
- a floor plate assembly removably fitted to the lower end of the magazine tube;
- a follower for bullets, axially slidably housed in the compartment of the magazine tube;
- a spring housed in the compartment of the magazine tube, permanently in compression between the floor plate assembly and the follower;
- wherein the magazine is configured to release the bullets from the top end in a longitudinal direction and towards the front portion of the magazine tube;
- wherein said floor plate assembly is removable from the lower end by sliding it from the front portion toward the rear portion;
- wherein the floor plate assembly comprises an L-shaped plate, provided with a primary portion for manually compressing the spring, and a floor plate that is removable from the lower end of the magazine tube, provided with a body compartment suitable to house said primary portion of the L-shaped plate;
- wherein the L-shaped plate and the floor plate are snap-engageable to attach the floor plate assembly to the magazine tube.

BRIEF DESCRIPTION OF THE DRAWINGS

The drawings described herein are for illustrative purposes only of selected embodiments and not all possible implementations and are not intended to limit the scope of the present disclosure.

FIRST EMBODIMENT

Figure 1B:
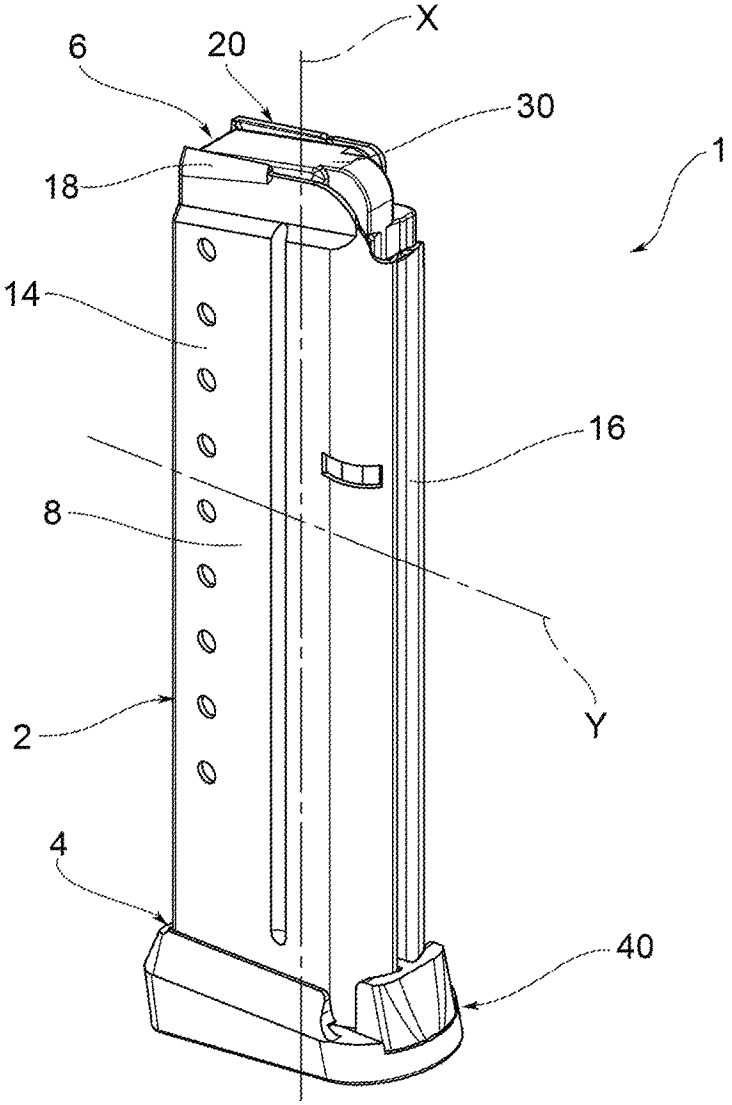
FIGS. 1*a* and 1*b* show a magazine according to the present invention, according to a first embodiment.
Figure 1A:
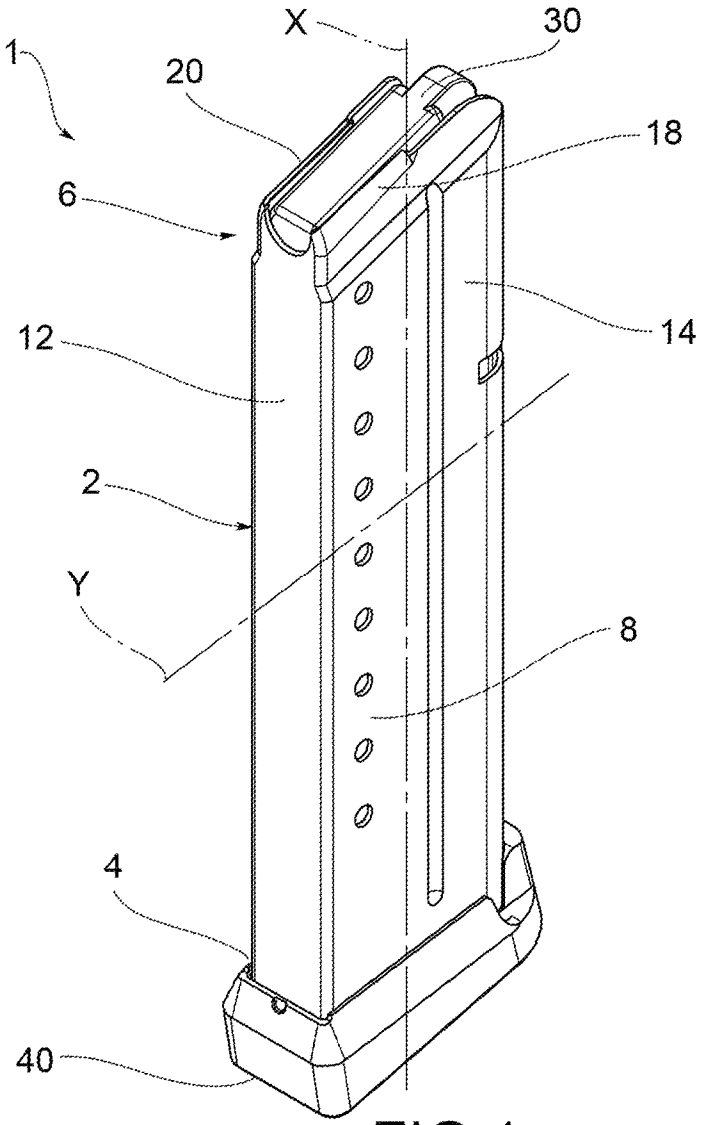
Figure 2:
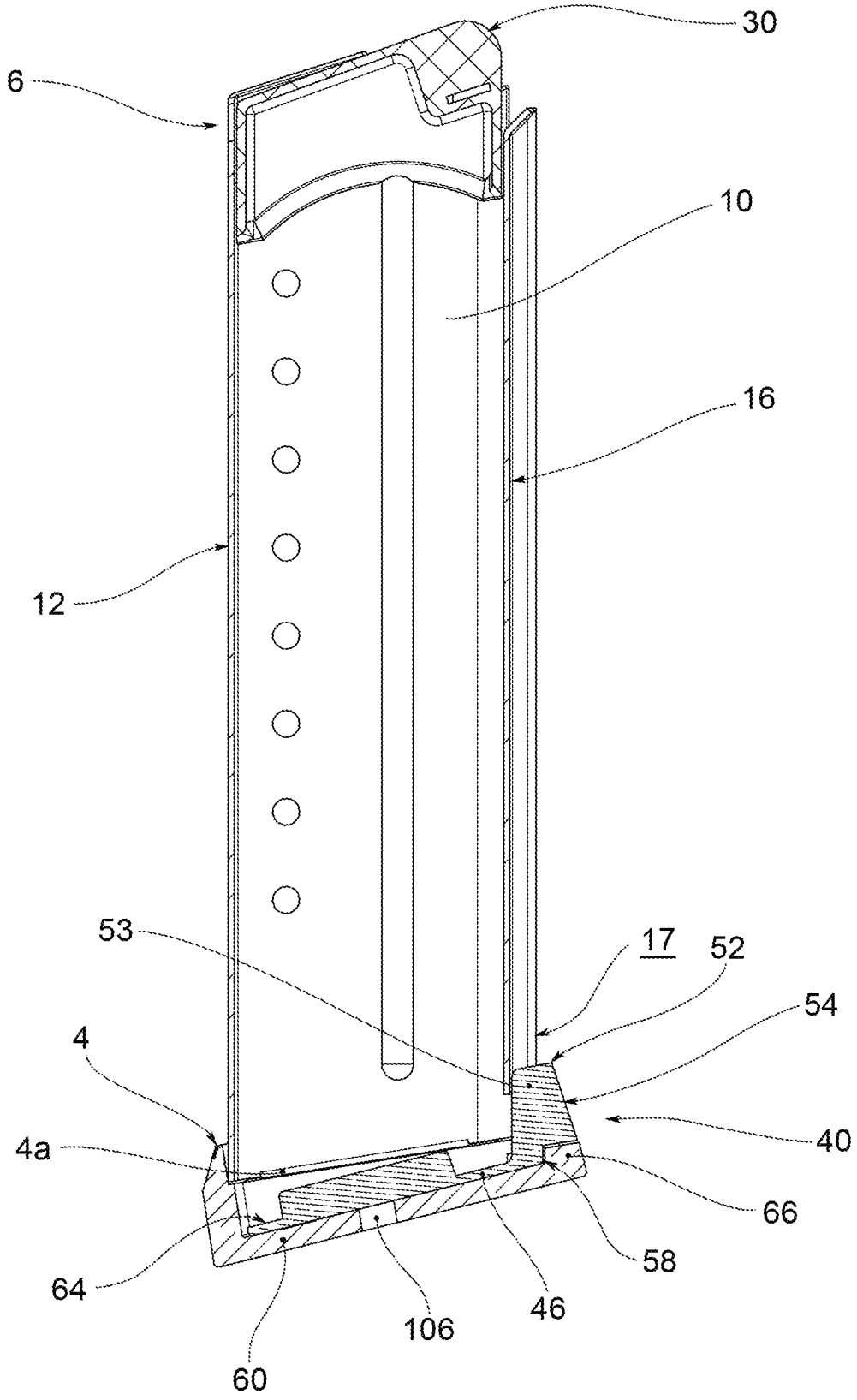
FIG. 2 shows a view in longitudinal section of the magazine of FIGS. 1*a* and 1*b*.
Figure 3:
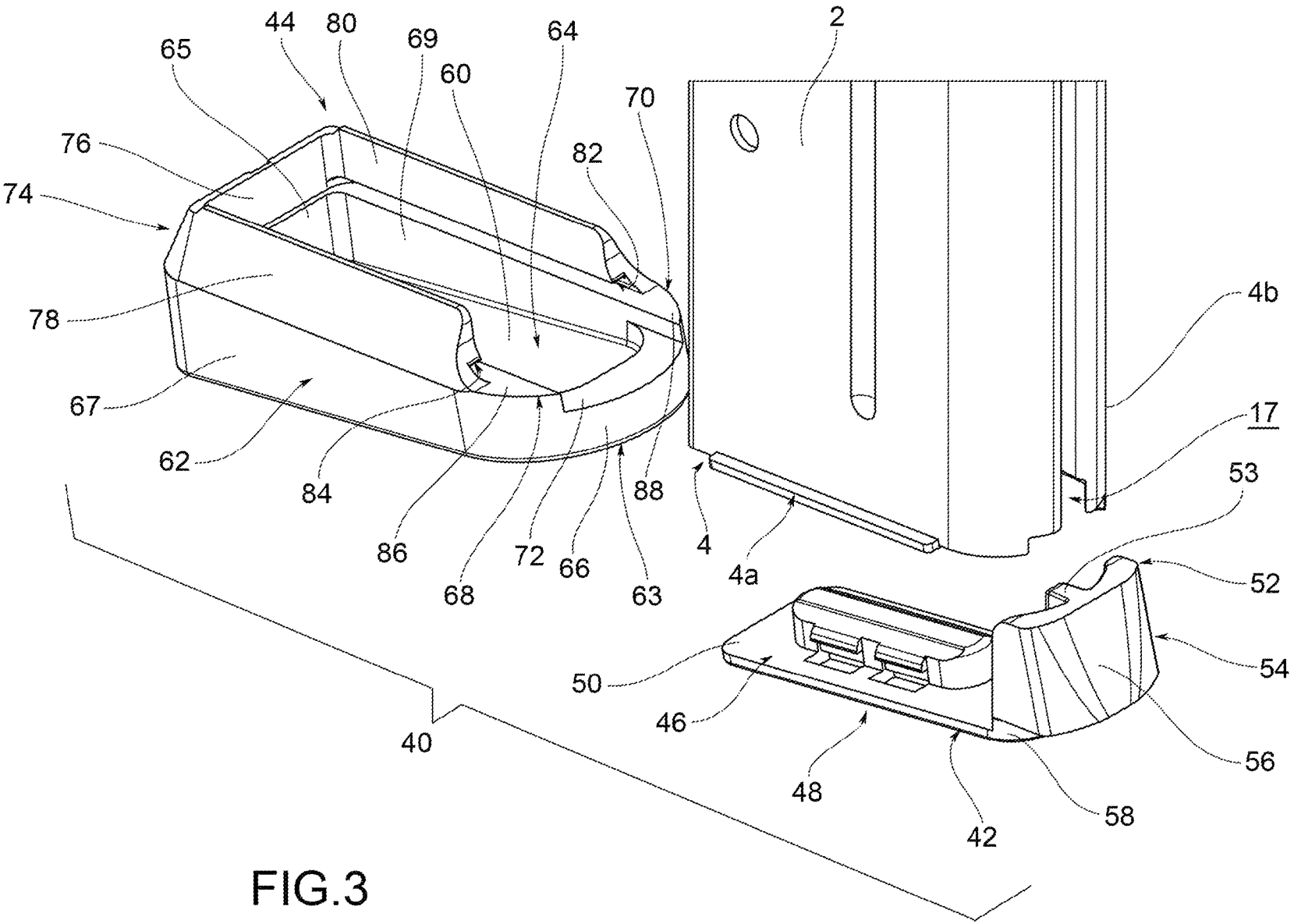
FIG. 3 represents a view in separate parts of a magazine tube and a floor plate assembly of the magazine of FIGS. 1*a* and 1*b*.

With reference to the accompanying figures, FIGS. 1*a* to 7*b* illustrate a first embodiment of a magazine according to the present invention. In particular, this embodiment refers to a single-column magazine, i.e. one that is able to contain a single column of superimposed bullets.

The magazine 1 comprises a magazine tube 2, usually made from a bent sheet, prismatic in shape with a predominant extension along a main axis X, between a lower end 4 and an upper end 6.

The magazine tube 2 comprises a lateral wall 8 that encloses within it a compartment 10 to accommodate the bullets; said lateral wall 8 comprises a rear portion 12, sides 14 and a front portion 16.

At the upper end 6, the lateral wall 8, and in particular the sides 14, are suitably folded inside or shaped, so as to form stop portions 18, 20 suitable to prevent the escape of the bullet in the direction of the main axis X; in particular, said stop portions 18, 20 are configured so as to retain the body of the bullet.

The configuration of the stop portions 18, 20 and possibly the upper surface of the follower, sometimes shaped to accommodate the bullet, define for the magazine the front area, towards which the bullet is aimed, and, consequently, the rear area. The direction of exit of the bullet from the magazine defines the longitudinal direction Y of the magazine.

The front portion 16 of the lateral wall 8 corresponds to the front area of the magazine 1; the rear portion 12 corresponds to the rear area.

At the lower end 4, the magazine tube 2 has a pair of longitudinal fins 4*a*, 4*b*, protruding externally transversely from the sides 14 of the magazine tube 2.

The magazine 1 further comprises a spring (not shown), housed in the compartment 10 of the magazine tube 2, permanently in compression between the bottom of the magazine and the follower 30.

The magazine 1 further comprises a floor plate assembly 40 attachable by longitudinal insertion at the lower end 4 of the magazine tube 2, in a removable way.

The floor plate assembly 40 comprises an L-shaped plate 42 and a floor plate 44.

The L-shaped plate 42, made in one piece, comprises a primary portion 46 with a substantially flat shape, having a lower face 48 and an upper face 50, facing the compartment 10 of the magazine tube 2.

The spring of the magazine is intended to abut against the upper face 50 of the primary portion 46.

On the front, the L-shaped plate 42 has a secondary portion 52 consisting of a wall that protrudes axially from the primary portion 46, at the front end thereof.

The secondary portion 52 has a front face 54 comprising an exposed portion 56 and an abutment portion 58, which turns inward relative to the exposed portion 56 and forms a step therewith.

The floor plate 44, constructed in one piece, has collectively a wrap-around shape, able to wrap around the lower end 4 of the magazine tube 2 when coupled thereto. In particular, when the floor plate 44 is coupled to the lower end 4 of the magazine tube 2, it overlaps the lower end 4, so as to partially cover the perimeter edge thereof.

In particular, the floor plate 44 comprises a body bottom 60 and a peripheral wall 62, protruding peripherally from the body bottom 60, so as to delimit a body compartment 64 suitable to house the primary portion 46 of the L-shaped plate 42.

In other words, the peripheral wall 62 comprises a front peripheral segment 63, a rear peripheral segment 65 and peripheral sides 67, 69 having longitudinal extension.

On the front, the peripheral wall 62 has a lowered portion 66 having a reduced height relative to the side portions 68, 70 that flank it; a lowered surface 72 of the lowered portion 66 is thus formed, flanked by said side portions 68, 70.

The lowered surface 72 and said lateral portions 68, 70 are suitable to guide the longitudinal insertion of the primary portion 46 of the L-shaped plate 42 into the body compartment 64 of the floor plate 44.

Moreover, the floor plate 44 comprises an additional wall 74 that extends with a predefined height above the peripheral wall 62, except for above the front peripheral segment 63, so as to allow the insertion of the lower end 4 of the magazine tube 2 and the L-plate 42.

In other words, the additional wall 74 extends above the peripheral sides 67, 69 and above the rear peripheral segment 65 thereof.

The additional wall 74 thus comprises an additional rear segment 76 and additional sides 78, 80. When the floor plate 44 is coupled to the lower end 4 of the magazine tube 2, the additional rear segment 76 and the additional sides 78, 80 of the additional wall 74 overlap the lower end 4, so as to cover the corresponding perimeter segments thereof.

Internally, the floor plate 44 has a pair of longitudinal grooves 82, 84 for the insertion by sliding of the fins 4*a*, 4*b* placed at the lower end 4 of the magazine tube 2.

Preferably, said grooves 82, 84 are obtained along the respective additional sides 78, 80 of the additional wall 74.

Preferably, moreover, said additional sides 78, 80 have a smaller longitudinal dimension of the peripheral sides of the peripheral wall 62, so as to leave two additional surfaces 86, 88 free for guiding the insertion of the fins 4*a*, 4*b* of the magazine tube 2.

As described hereinafter, to perform a maintenance operation on the magazine 1, the floor plate assembly 40 is removed from the magazine tube 2 and the spring and the follower 30 are extracted from inside thereof.

After the maintenance operations have been completed, the follower 30 is inserted back into the magazine tube, as is the spring, which, however, remains partly outside the magazine tube 2, due to the free length thereof.

Figure 4A:
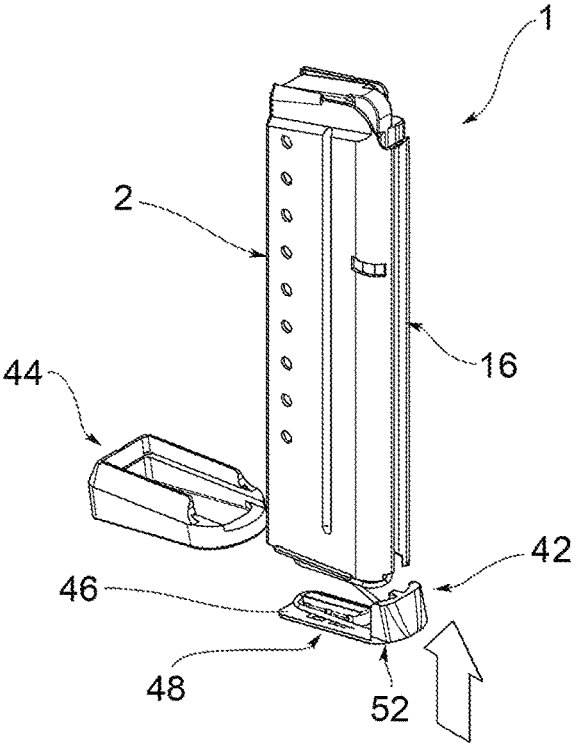
FIGS. 4*a*, 4*b*; 5*a*, 5*b*; 6*a*, 6*b* and 7*a*, 7*b* schematically show a method for mounting the floor plate assembly to the magazine tube of the magazine of FIGS. 1*a* and 1*b*.
Figure 5A:
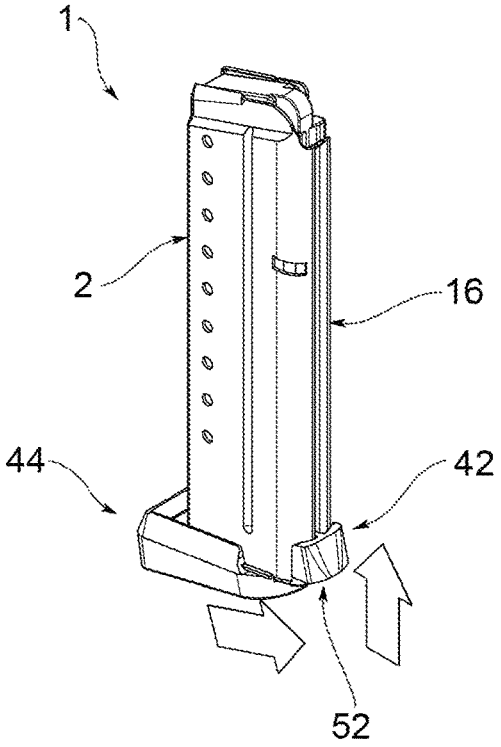
Figure 4B:
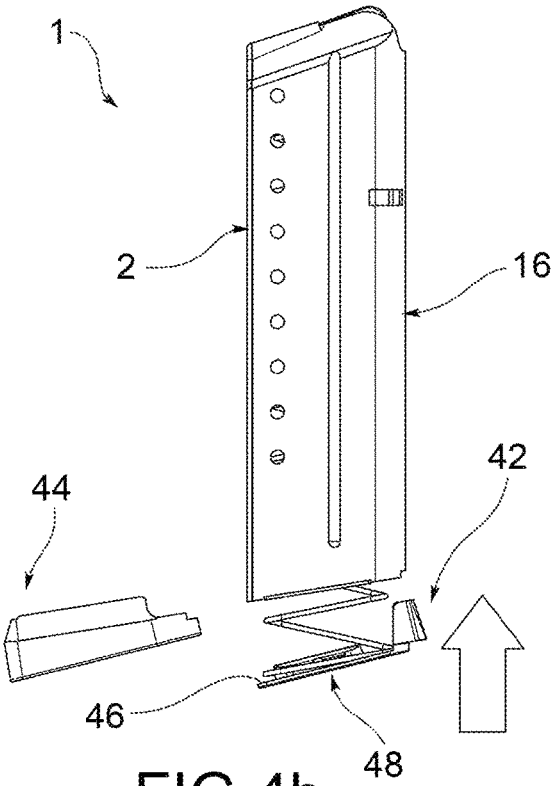
Figure 5B:
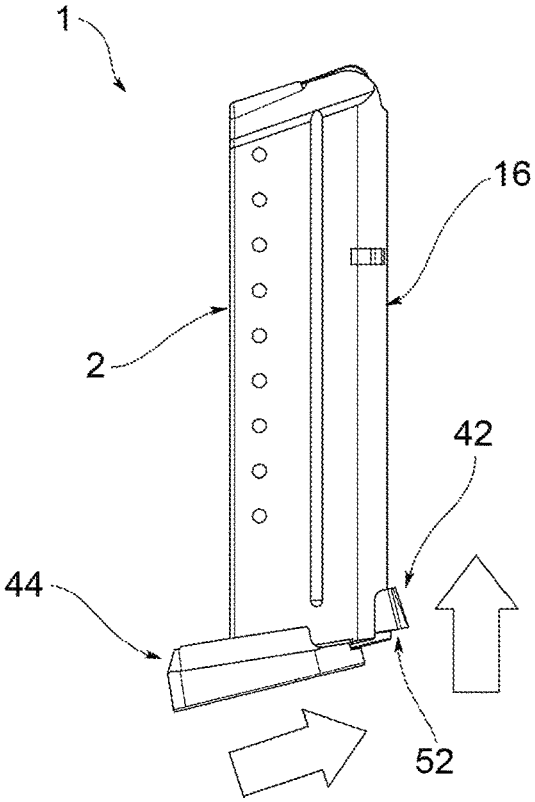
Figure 6A:
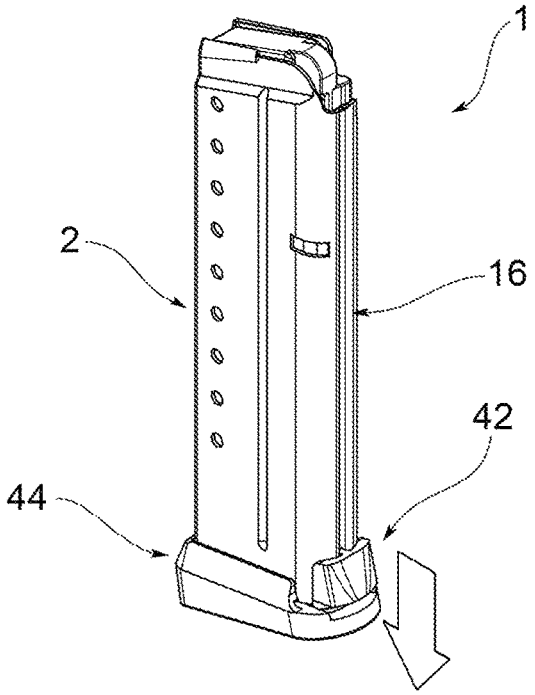

Using the L-shaped plate 42, and in particular by resting the end of the spring that emerges from the magazine tube on the primary portion of the L-shaped plate 42, it is possible to compress the spring, until the L-shaped plate 42 is brought in the vicinity of or in abutment with the lower end 4 of the magazine tube 2 (FIGS. 4*a* and 4*b*).

In this configuration, the secondary portion 52 of the L-shaped plate 42 is in abutment with the front portion 16 of the magazine tube 2.

Preferably, the secondary portion 52 comprises a rib 53 which, when the secondary portion 52 of the L-shaped plate 42 is in abutment with the front portion 16 of the magazine tube 2, engages with a seat 17 formed in the front portion 16, to stabilize the positioning of the L-shaped plate 42 relative to the magazine tube 2.

The floor plate 44 of the floor plate assembly 40 is inserted longitudinally on the lower end 4 of the magazine tube 2, in a direction that goes from the rear area towards the front area, so that the fins 4*a*, 4*b* slide into the respective grooves 82, 84 of the floor plate 44 (FIGS. 5*a*, 5*b* and 6*a*, 6*b*).

During insertion, the primary portion 46 of the L-shaped plate 42 is guided by the lowered surface 72 and by the side portions 68, 70, so that insertion is particularly easy.

Moreover, during the longitudinal insertion, the fins 4*a*, 4*b* of the magazine tube 2 are contained in the grooves 82, 84 and the L-shaped plate 42 on which the action of the compressed spring pushes is placed between said fins 4*a*, 4*b* and the lowered portion 66 which supports it; therefore, even when releasing one's grip on the L-shaped plate 42, the magazine tube—L-shaped plate—floor plate assembly remains mutually engaged, thus making assembly easier.

In other words, the floor plate 44, engaged with the fins 4*a*, 4*b*, counteracts the separation of the L-shaped plate 42 from the lower end 4.

Figure 7A:
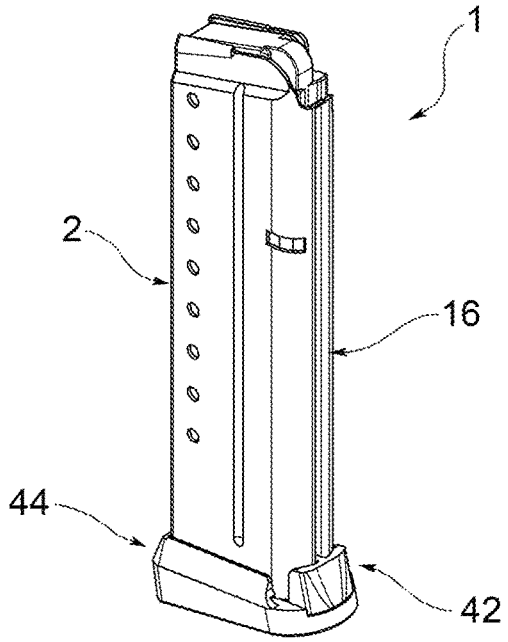
Figure 6B:
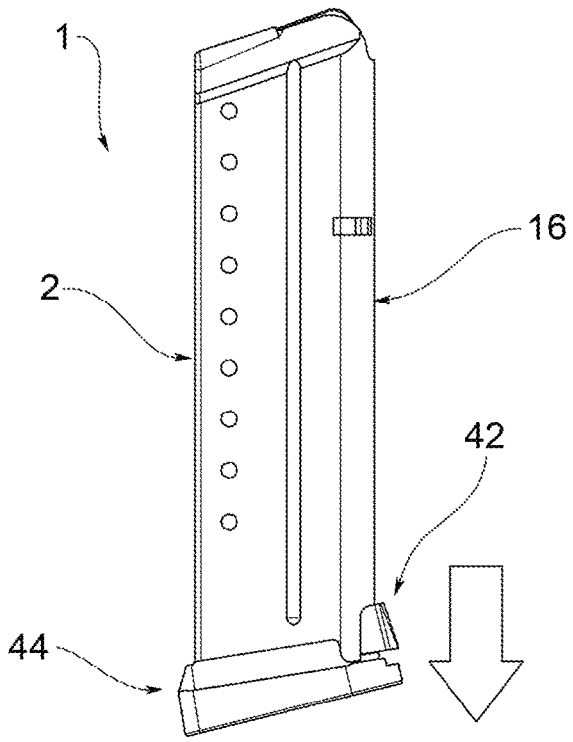
Figure 7B:
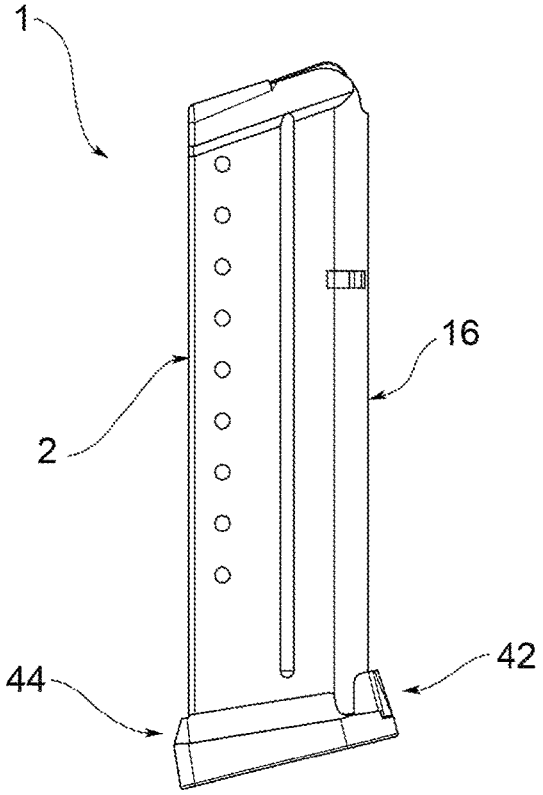
Figure 8B:
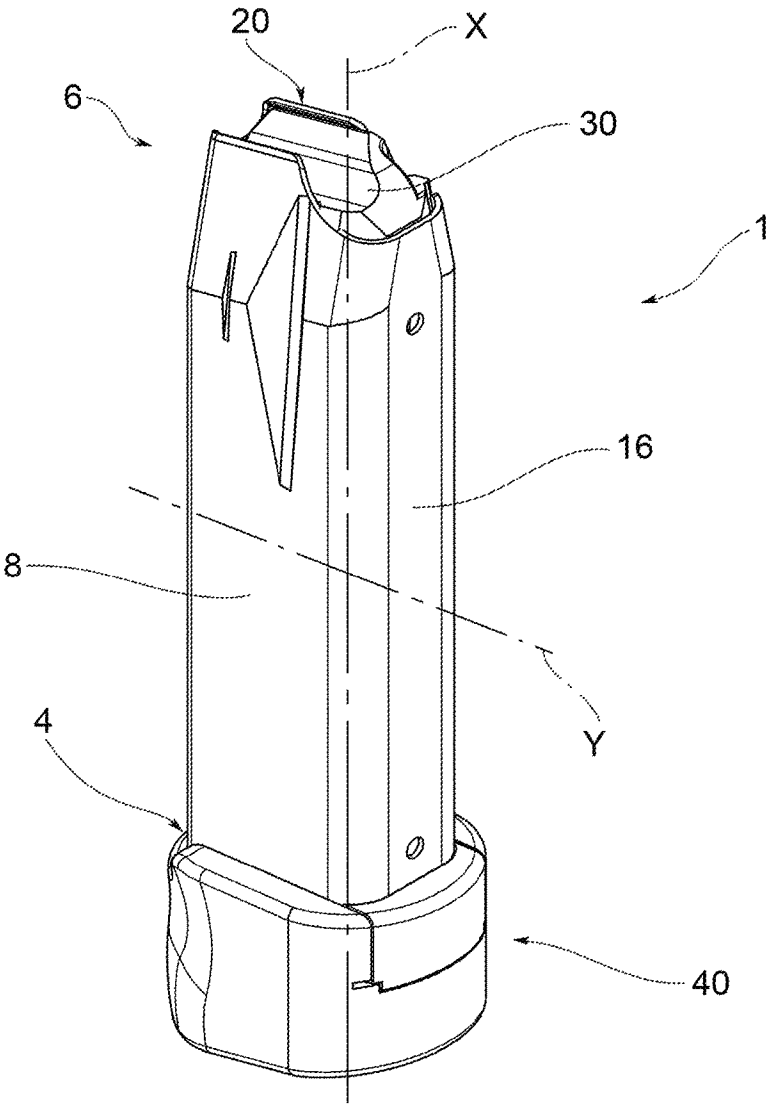
FIGS. 8*a* and 8*b* show a magazine according to the present invention, according to a further embodiment.
Figure 8A:
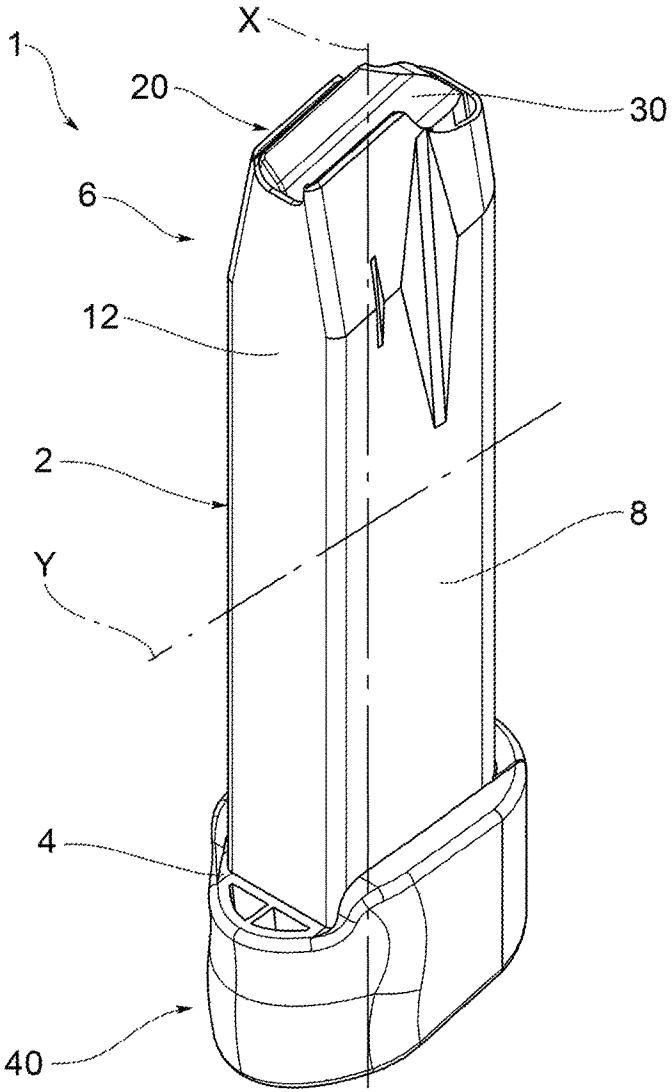
Figure 9:
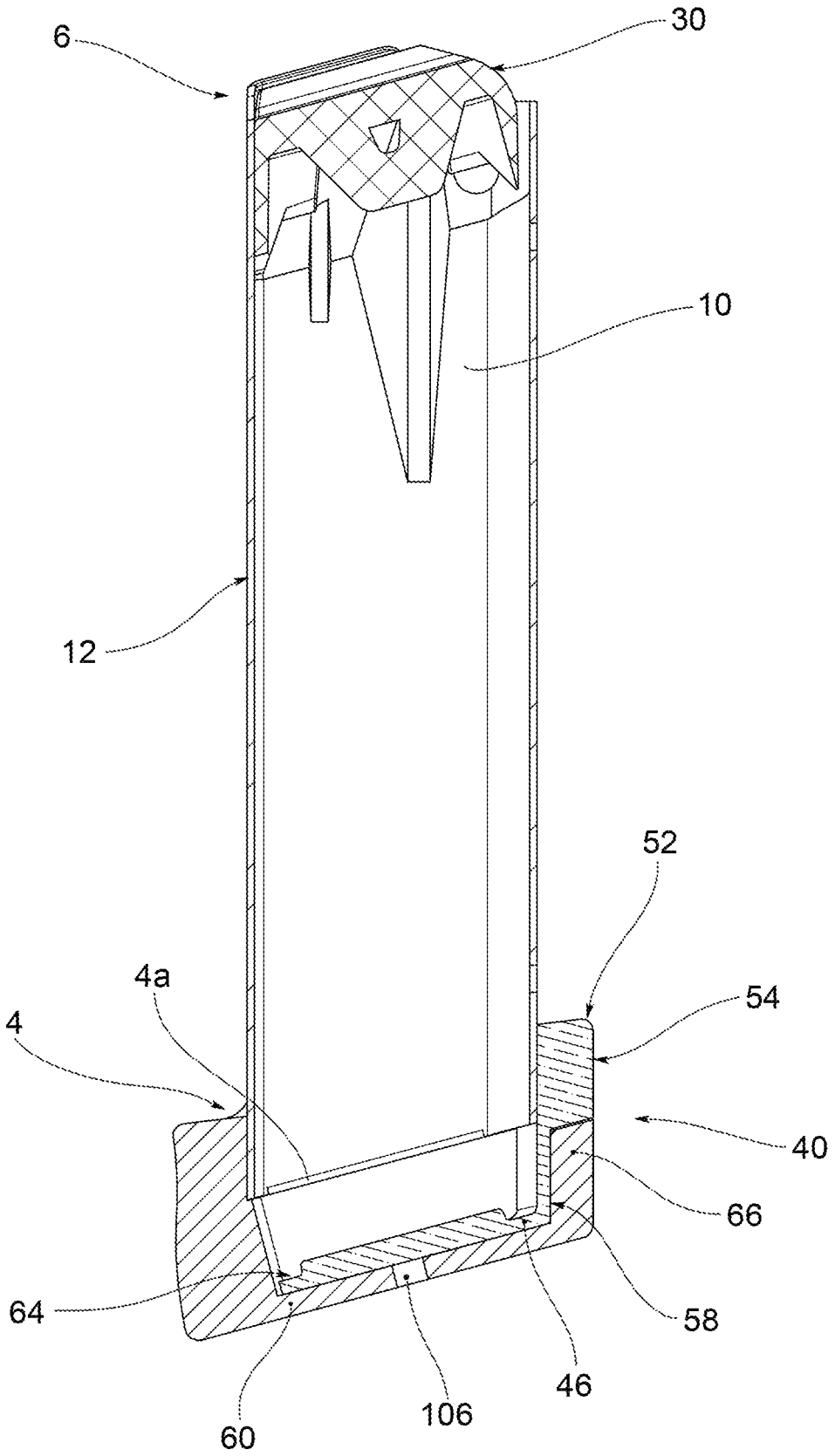
FIG. 9 shows a view in longitudinal section of the magazine of FIGS. 8*a* and 8*b*.
Figure 10:
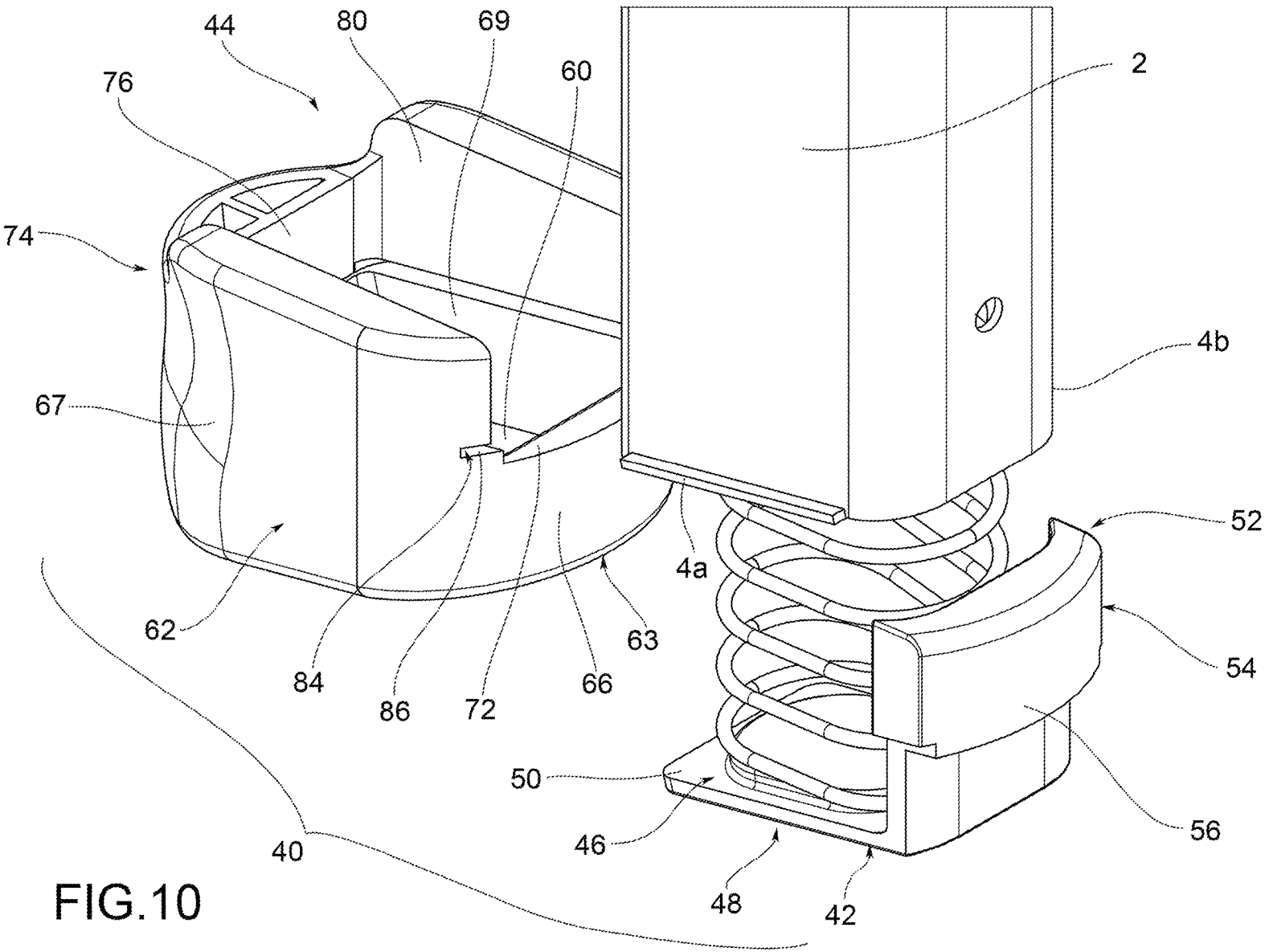
FIG. 10 shows a view in separate parts of a magazine tube and a floor plate assembly of the magazine of FIGS. 8*a* and 8*b*.
Figure 11A:
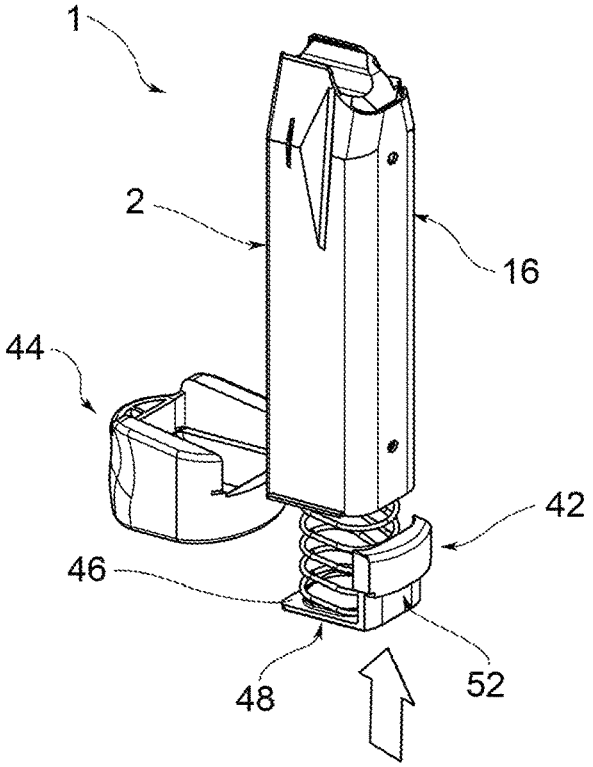
FIGS. 11*a*, 11*b*; 12*a*, 12*b*; 13*a*, 13*b* and 14*a*, 14*b* schematically show a method for mounting the floor plate assembly to the magazine tube of the magazine of FIGS. 8*a* and 8*b*.
Figure 12A:
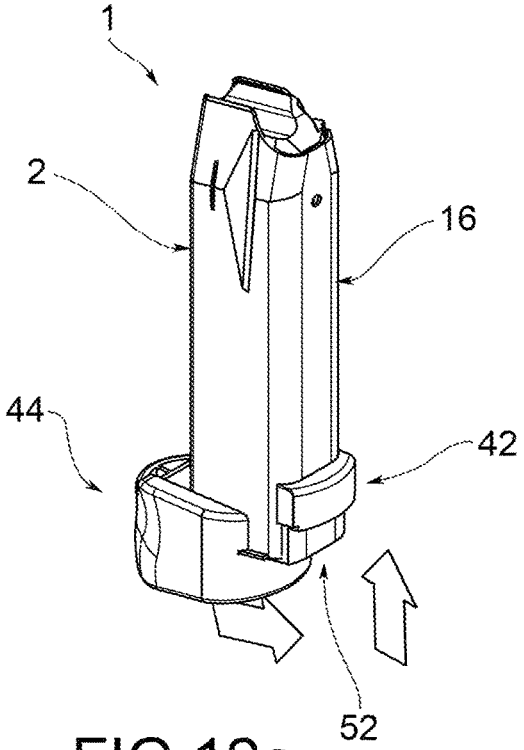
Figure 11B:
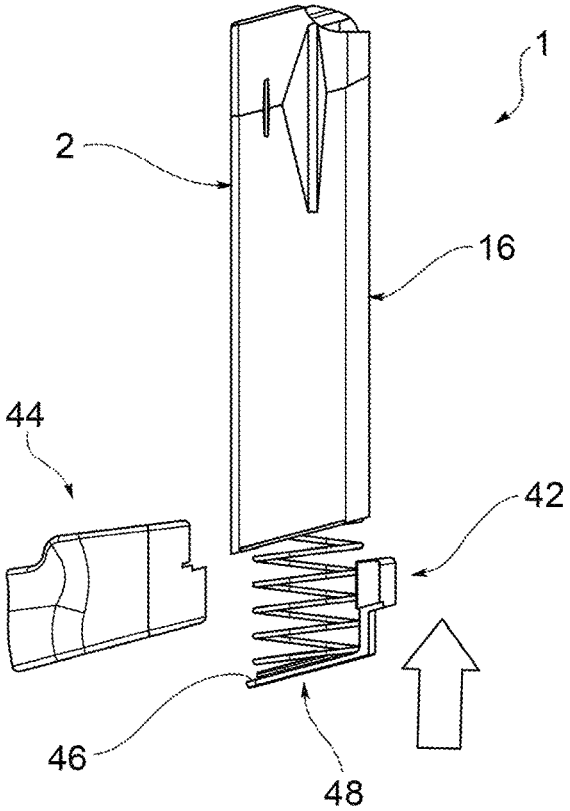
Figure 12B:
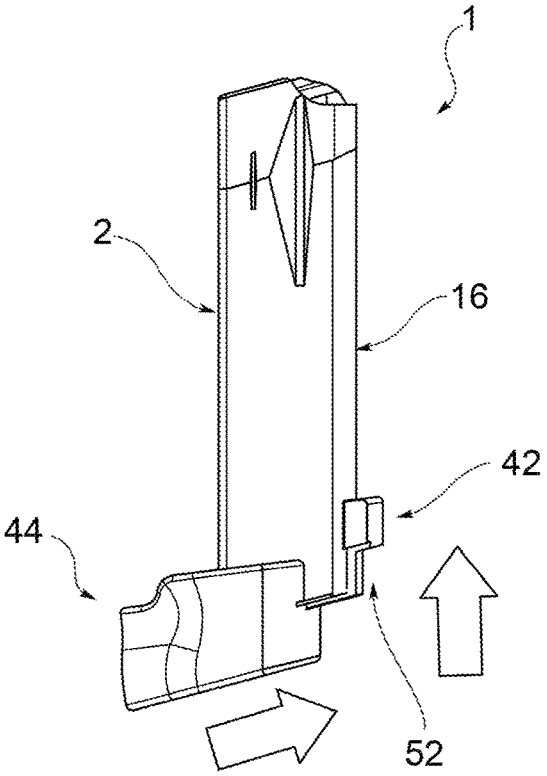
Figure 13A:
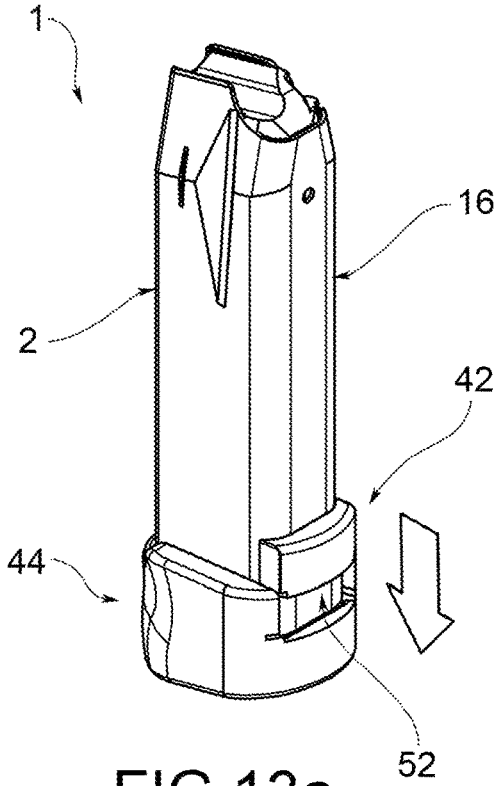
Figure 14A:
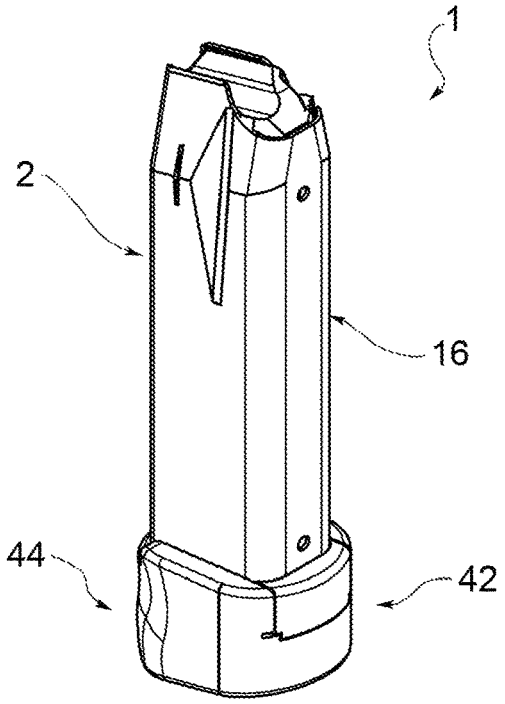
Figure 13B:
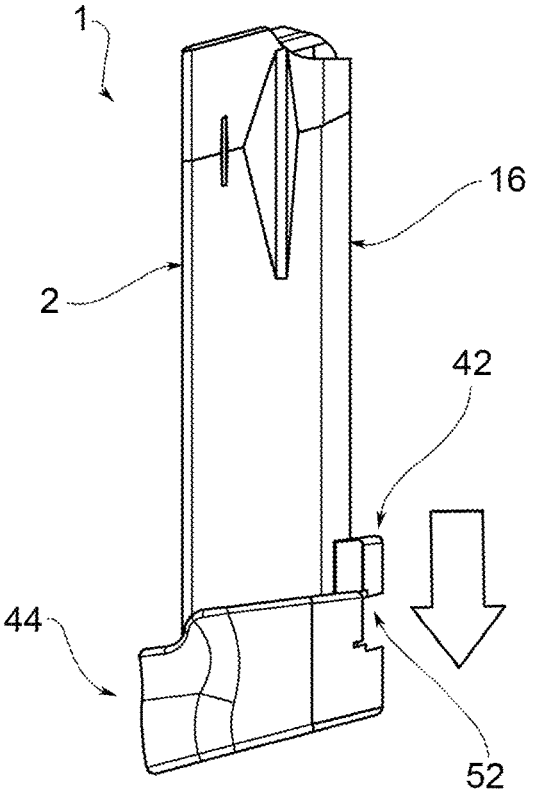
Figure 14B:
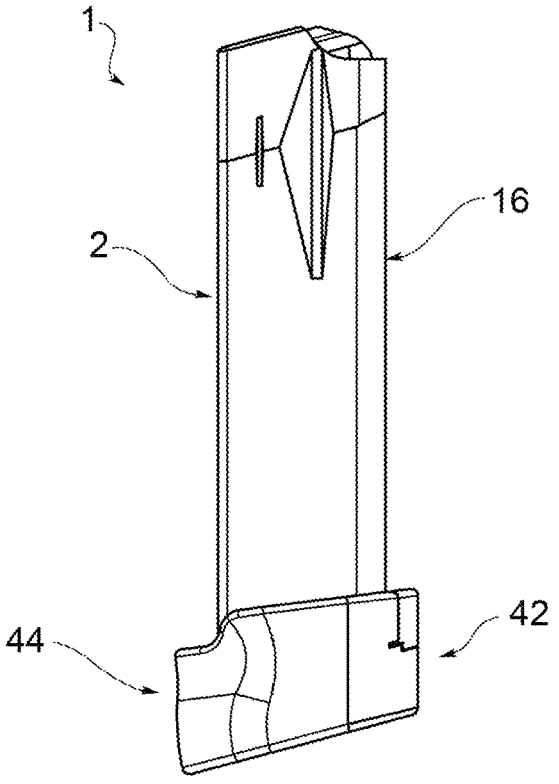

Once the primary portion 46 has been completely inserted, said primary portion 46 is no longer supported by the lowered portion 66, whereby, under the action of the spring, it snaps into the body compartment 64 of the floor plate 44, locking the floor plate assembly 40 to the magazine tube 2 (FIGS. 7*a* and 7*b*).

In particular, in the final engagement configuration, the primary portion 46 is housed in the body compartment 64, the abutment portion 58 of the secondary portion 52 abuts internally with the lowered portion 66, while the exposed portion 56 is arranged above the lowered surface 72.

In the final engagement configuration:

the axial disengagement of the floor plate assembly 40 from the magazine tube 2 is prevented by the fins 4*a*, 4*b* inserted in the grooves 82, 84;

the disengagement due to longitudinal sliding of the floor plate 44 with respect to the magazine tube 2, from the front area towards the rear area, is prevented by the lowered portion 66 of the floor plate 44, which is in abutment with the abutment portion 58 of the L-shaped plate 42, which in turn is integral with the exposed portion 56 of the L-shaped plate 42, which is in abutment with the front portion 16 of the magazine tube 2;

the disengagement by longitudinal sliding of the floor plate 44 with respect to the magazine tube 2, from the rear area towards the front area, is prevented by the peripheral rear segment 65, which abuts with the rear portion 12 of the magazine tube 2.

Figure 15:
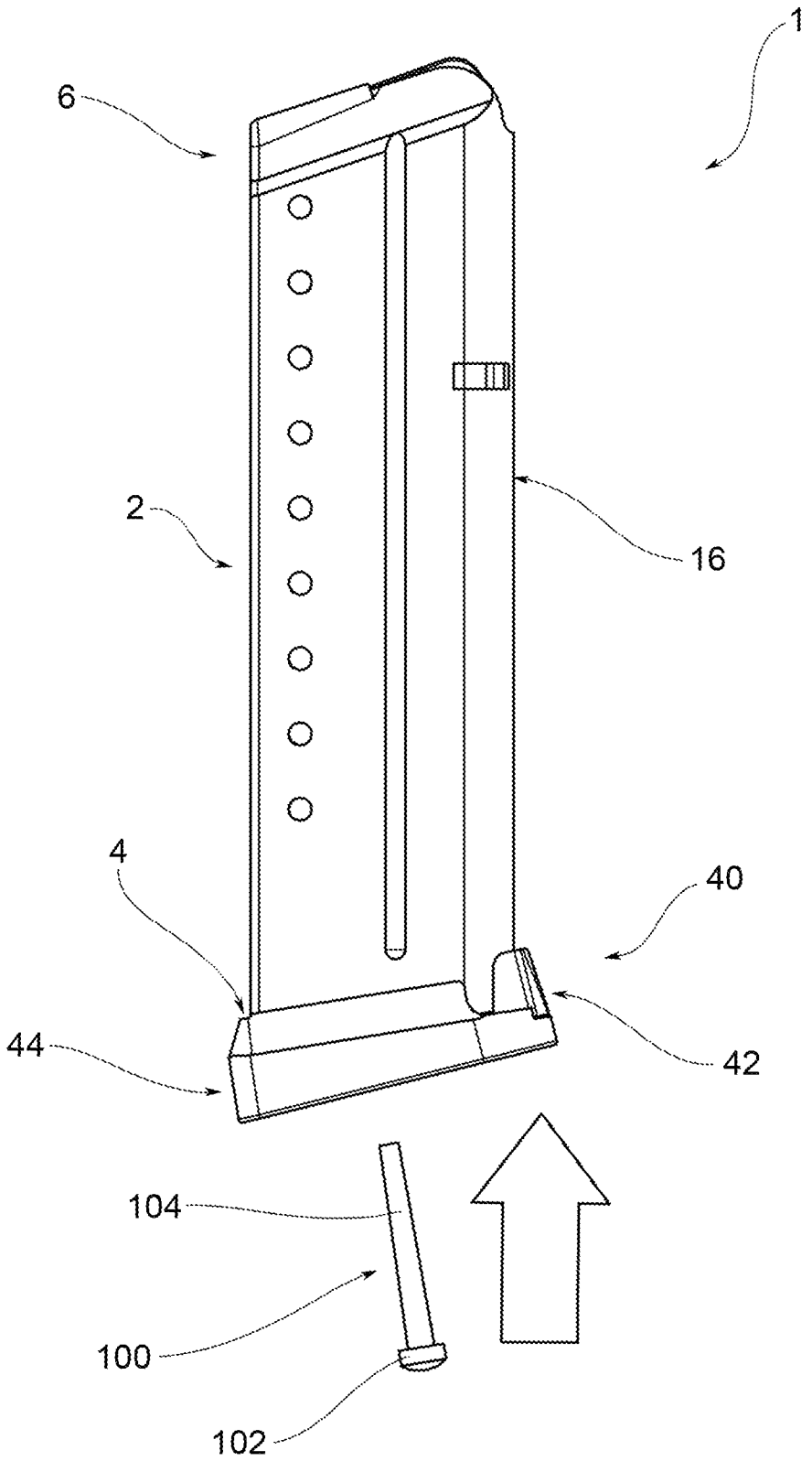
FIG. 15 shows a magazine with tool for disassembling the floor plate assembly of the magazine, according to an embodiment of the present invention.

For the disassembly of the floor plate assembly 40 from the magazine tube 2, a disassembly tool 100 (FIG. 15) is used, comprising a gripping portion 102 and a functional portion 104, consisting of an elongated element suitable to be inserted into a through-hole 106 provided through the body bottom 60 of the floor plate 44.

Once the elongated element has been inserted into the through-hole 106, the elongated element abuts against the primary portion 46 of the L-shaped plate 42, housed in the body compartment 64; by pushing the disassembly tool 100, the primary portion 46 lifts to abut against the lower end 4 of the magazine tube 2.

In this way, the abutment portion 58 of the secondary portion 52 is no longer in abutment with the lowered portion 66.

With the thumb on the exposed portion 56, the operator may lock the L-shaped plate 42 in the abutment position of the magazine tube 2 and remove the assembly tool 100; the floor plate 44 may thus be removed from the lower end 4 of the magazine tube 2, by longitudinal sliding from the front area towards the rear area.

SECOND EMBODIMENT

FIGS. 8*a* to 14*b* illustrate a further embodiment of the invention, in which the magazine is double-column, i.e. able to accommodate two rows of superimposed bullets, side by side.

The structural and functional features of this embodiment are identical to those described for the first embodiment and the figures show the same numerical references to indicate corresponding parts.

Innovatively, the magazine according to the present invention overcomes the drawbacks mentioned in reference to the known art.

In particular, advantageously, when the magazine falls, striking the rear area, this impact does not cause the disengagement of the floor plate assembly or the breakage of the floor plate, since the rear peripheral segment of the peripheral wall is strong enough to absorb the impact and is made in a single piece with the rest of the floor plate.

Similarly, if the impact were to occur at the front area, there would be no disassembly of the floor plate assembly.

Moreover, the assembly of the floor plate assembly after maintenance operations is particularly easy, by virtue of the guided insertion of the L-shaped plate in the floor plate.

Furthermore, the shoe shape of the floor plate, which allows some peripheral segments of the lower end of the magazine tube to overlap, allows the most dangerous impacts to be absorbed.

Similarly, advantageously, the disassembly of the floor plate assembly for maintenance operations is particularly easy, due to the use of the disassembly tool.

What is claimed is:

1. A magazine for a firearm, comprising:

a magazine tube having a predominant extension along a main axis between a lower end and an upper end, comprising a lateral wall enclosing a compartment, wherein the lateral wall comprises a rear portion, sides and a front portion;

a floor plate assembly removably fitted to the lower end of the magazine tube;

a follower for bullets, axially slidably housed in the compartment of the magazine tube;

a spring housed in the compartment of the magazine tube, permanently compressed between the floor plate assembly and the follower;

wherein the magazine is configured to release the bullets from the top end in a longitudinal direction and towards the front portion of the magazine tube;

wherein said floor plate assembly is removable from the lower end, from the front portion towards the rear portion;

wherein the floor plate assembly comprises an L-shaped plate, provided with a primary portion for manually compressing the spring, and a floor plate that is removable from the lower end of the magazine tube, provided with a body compartment suitable to house said primary portion of the L-shaped plate;

wherein the L-shaped plate and the floor plate are snap-engageable to attach the floor plate assembly to the magazine tube.

2. A magazine according to claim 1, wherein, in a final engagement configuration wherein the L-shaped plate is engaged with the floor plate, the primary portion of the L-shaped plate is housed in the body compartment of the floor plate.

3. A magazine according to claim 1, wherein the L-shaped plate comprises a secondary portion having a front face comprising an abutment portion;

wherein, in the final engagement configuration, the abutment portion is in abutment with a lowered wall of the floor plate.

4. A magazine according to claim 1, wherein the floor plate comprises a body bottom provided with at least one opening through which the primary portion of the L-shaped plate is accessible to be raised against the action of the spring, in order to disengage the floor plate from the magazine tube.

5. A magazine according to claim 1, wherein the magazine tube comprises fins having longitudinal extension and projecting externally transversely from the lower end; and wherein the floor plate comprises longitudinal grooves configured for the insertion and longitudinal sliding of said fins.

6. A magazine according to claim 1, wherein the body compartment is delimited at the rear by a peripheral rear segment and at the sides by peripheral sides, in a single piece.

7. A magazine according to claim 1, wherein the floor plate is shaped like a shoe to overlap at least one rear segment of the peripheral edge of the lower end of the magazine tube.

8. A method of assembling a floor plate assembly at the lower end of a magazine tube of a magazine for a firearm, comprising the following steps in sequence:

compressing a spring into the magazine tube by means of an L-shaped plate of the floor plate assembly, pushing the L-shaped plate towards the lower end;

engaging a floor plate of the floor plate assembly with the magazine tube, inserting the floor plate at the lower end, longitudinally from a front portion towards a rear portion of the magazine tube, counteracting with the floor plate the separation of the L-shaped plate from the lower end;

continuing to insert the floor plate until the L-shaped plate snaps into place with the floor plate.

9. The method of claim 8, wherein the floor plate comprises a body bottom provided with at least one opening through which a primary portion of the L-shaped plate is accessible to be raised against the action of the spring.

10. The method of claim 8, wherein the magazine tube comprises fins having longitudinal extension and projecting externally transversely from the lower end; and wherein the floor plate comprises longitudinal grooves configured for the insertion and longitudinal sliding of said fins.

11. The magazine of claim 4, wherein the at least one opening is operable to receive a disassembly tool therethrough, the disassembly tool operable to engage at least a portion of the primary portion and compress the spring, thus disengaging the L-shaped plate from the floor plate.

12. The magazine of claim 11, wherein the disassembly tool has a gripping portion and an elongated portion operable for at least a portion to be received in the at least one opening.

* * * * *